US006386678B1

(12) United States Patent
Michael et al.

(10) Patent No.: US 6,386,678 B1
(45) **Date of Patent: *May 14, 2002**

(54) HIGH DEFLECTION CAPPING SYSTEM FOR INKJET PRINTHEADS

(75) Inventors: Donald L. Michael, East Monmouth, OR (US); John D. Rhodes, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 91 days.

This patent is subject to a terminal disclaimer.

(21) Appl. No.: 09/640,337

(22) Filed: Aug. 16, 2000

Related U.S. Application Data

(63) Continuation of application No. 09/348,902, filed on Jul. 6, 1999, now Pat. No. 6,151,043, which is a continuation-in-part of application No. 08/808,366, filed on Feb. 28, 1997, now Pat. No. 5,956,053, which is a continuation-in-part of application No. 08/741,850, filed on Oct. 31, 1996, now Pat. No. 5,936,647.

(51) Int. Cl.[7] ..... B41J 2/165
(52) U.S. Cl. ..... 347/29
(58) Field of Search ..... 347/29, 30–35

(56) References Cited

U.S. PATENT DOCUMENTS

| | | | | |
|---|---|---|---|---|
| 4,683,481 A | | 7/1987 | Johnson | 347/65 |
| 4,853,717 A | | 8/1989 | Harmon et al. | 347/29 |
| 5,027,134 A | | 6/1991 | Harmon et al. | 347/29 |
| 5,086,305 A | | 2/1992 | Terasawa | 347/30 |
| 5,103,244 A | | 4/1992 | Gast et al. | 347/33 |
| 5,115,250 A | | 5/1992 | Harmon et al. | 347/33 |
| 5,146,243 A | | 9/1992 | English et al. | 347/29 |
| 5,155,497 A | | 10/1992 | Martin et al. | 347/33 |
| 5,216,449 A | | 6/1993 | English | 347/29 |
| 5,252,993 A | | 10/1993 | Tomii et al. | 347/32 |
| 5,278,584 A | | 1/1994 | Keefe et al. | 347/63 |
| 5,394,178 A | | 2/1995 | Grange | 347/32 |
| 5,440,331 A | | 8/1995 | Grange | 347/32 |
| 5,448,270 A | | 9/1995 | Osborne | 347/29 |
| 5,455,609 A | | 10/1995 | Gast et al. | 347/32 |
| 5,471,230 A | | 11/1995 | Saito et al. | 347/29 |
| 5,517,220 A | | 5/1996 | English | 347/29 |
| 5,563,638 A | | 10/1996 | Osborne | 347/32 |
| 5,682,186 A | | 10/1997 | Bohorquez et al. | 347/29 |
| 5,867,184 A | | 2/1999 | Quintana | 347/29 |
| 5,936,647 A | | 8/1999 | Rhode et al. | 347/29 |
| 5,956,053 A | | 9/1999 | Michael | 347/29 |
| 6,151,043 A | * | 11/2000 | Michael et al. | 347/29 |

* cited by examiner

*Primary Examiner*—N. Le
*Assistant Examiner*—Shih-Wen Hsieh
(74) *Attorney, Agent, or Firm*—Flory L. Martin

(57) ABSTRACT

A high deflection capping system has an elastomeric sealing member with a sealing lip that, when viewed in cross section, forms a smiling-shaped seal against an inkjet printhead to provide improved printhead sealing, particularly when sealing over surface irregularities on the printhead. This high deflection sealing member may be onsert molded onto a support frame. A series of these sealing lips being molded on a single flexible frame to simultaneously seal several adjacent inkjet printheads, with the flexible frame having a border region with one or more cap bases attached to the frame by plural suspension spring elements. The suspension spring elements have both cantilever and torsional characteristics which allow the bases to tilt and twist independent of one another to seal each printhead. Alternatively, the support frame may be designed to support only a single high deflection sealing member. A venting system is also provided with vapor diffusion handling capabilities.

14 Claims, 9 Drawing Sheets

HIGH DEFLECTION CAPPING SYSTEM FOR INKJET PRINTHEADS

CROSS REFERENCE TO RELATED APPLICATIONS

This is a continuation of application Ser. No. 09/348,902 filed on Jul. 6, 1999, now U.S. Pat. No. 6,151,043.

RELATED APPLICATION

This is a continuation-in-part application of the U.S. patent application Ser. No. 08/808,366, filed on Feb. 28, 1997, now U.S. Pat. No. 5,596,053, which is a continuation-in-part application of U.S. patent application Ser. No. 08/741,850, filed on Oct. 31, 1996, now U.S. Pat. No. 5,936,647, all having at least one co-inventor in common.

FIELD OF THE INVENTION

The present invention relates generally to inkjet printing mechanisms, and more particularly to a high deflection capping system having an elastomeric sealing member with a sealing lip that, when viewed in cross section, forms a smiling-shaped seal against an inkjet printhead to provide improved printhead sealing, particularly when sealing over surface irregularities on the printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, these service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper.

Early inkjet printer used a single monochromatic pen, typically carrying black ink. Later generations of inkjet printing mechanisms used a black pen which was interchangeable with a tri-color pen, typically one carrying the colors of cyan, magenta and yellow within a single cartridge. The tri-color pen printed a "process" or "composite" black image, by depositing drops of cyan, magenta, and yellow inks all at the same location. Unfortunately, the composite black images usually had rough edges, and a non-black hue or cast, depending for instance, upon the type of paper used. The next generation of printers further enhanced the images by using either a dual pen system or a quad pen system. The dual pen printers had a black pen and a tri-color pen mounted in a single carriage to print crisp, clear black text while providing full color images.

The quad pen printing mechanisms had four separate pens that carried black ink, cyan ink, magenta ink, and yellow ink. Quad pen plotters typically carried four pens in four separate carriages, so each pen needed individual servicing. Quad pen desktop printers were designed to carry four cartridges in a single carriage, so all four cartridges could be serviced by a single service station. As the inkjet industry investigates new printhead designs, there is a trend toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote location, typically inside a desktop printer, although large format plotters and industrial implementations may store their ink supplies external to the printing mechanism. The smaller on-board ink supply makes these off-axis desktop printers quite suitable for quad pen designs.

These earlier dual and quad pen printers required an elaborate capping mechanism to hermetically seal each of the printheads during periods of inactivity. A variety of different mechanisms have been used to move the servicing implements into engagement with respective printheads. For example, a dual printhead servicing mechanism which moves the caps in a perpendicular direction toward the orifice plates of the printheads is shown in U.S. Pat. No. 5,155,497, assigned to the present assignee, Hewlett-Packard Company, of Palo Alto, Calif. Another dual printhead servicing mechanism uses the carriage to pull the caps laterally up a ramp and into contact with the printheads, as shown in U.S. Pat. No. 5,440,331, also assigned to the Hewlett-Packard Company. A rotary device for capping dual inkjet printheads is commercially available in several models of printers produced by the Hewlett-Packard Company of Palo Alto, Calif., including the DeskJet® 850C, 855C, 820C and 870C model printers. Examples of a quad pen capping system that uses a translation motion are seen in several other commercially available printers produced by the Hewlett-Packard Company, including the DeskJet® 1200 and 1600 models. Thus, a variety of different mechanisms and angles of approach may be used to physically move the caps into engagement with the printheads.

The caps in these earlier service station mechanisms typically included an elastomeric sealing lip supported by a movable platform or sled. Typically, provisions were made for venting the sealing cavity as the cap lips are brought into contact with the printhead. Without a venting feature, air could be forced into the printhead nozzles during capping, which could deprime the nozzles. A variety of capillary passageway venting schemes are known to those skilled in the art, such as those shown in U.S. Pat. Nos. 5,027,134; 5,216,449; and 5,517,220, all assigned to the present assignee, the Hewlett-Packard Company.

The earlier cap sleds were often produced using high temperature thermoplastic materials or thermoset plastic materials which allowed the elastomeric sealing lips to be onsert molded onto the sled. The elastomeric sealing lips were sometimes joined at their base to form a cup-like structure, whereas other cap lip designs projected upwardly from the sled, with the sled itself forming the bottom portion of the sealing cavity. Unfortunately, the systems which used a portion of the sled to define the sealing cavity often had leaks where the cap lips joined the sled. To seal these leaks at the lip/sled interface, higher capping forces were used to physically push the elastomeric lip into a tight seal with the sled. This solution was unfortunate because these higher capping forces may damage, unseat or misalign the printhead, or at the vary least require a more robust printhead design which is usually more costly.

Capping systems need to provide an adequate seal while accommodating a several different types of variations in the printhead. For example, today's printhead orifice plates often have a waviness or ripple to their surface contour because commercially available orifice plates unfortunately are not perfectly planar. Besides waviness, these orifice plates may also be slightly bowed in a convex, concave or compound (both convex and concave) configuration. The waviness property may generate a height variation of up to 0.05–0.08 millimeters (2–3 mils; 0.002–0.003 inches). These orifice plates may also have some inherent surface roughness over which the cap must seal. The typical way of coping with both the waviness problem and the surface roughness problem is through elastomer compliance, where a soft material is used for the cap lips. The soft cap lips compress and conform to seal over these irregularities in the orifice plate. For instance, one earlier suspended lip configuration having a single upwardly projecting ridge for a sealing lip is shown in U.S. Pat. No. 5,448,270, assigned to the Hewlett-Packard Company, the present assignee.

Another major surface irregularity over which some printhead caps must seal are two encapsulant beads which attach each end of the silicon nozzle plate to a portion of an electrical flex circuit which delivers firing signals to energize the printhead resistors. An energized resistor heats the ink until a droplet is ejected from the nozzle associated with the energized resistor. These encapsulant beads project beyond the outer surface of the nozzle plates. In the past, caps were designed to avoid sealing over the encapsulant bead regions, either by sealing between the beads or beyond them. One printer design, the DeskJet® 693C color inkjet printer sold by the Hewlett-Packard Company of Palo Alto, Calif., has a capping system that accommodates interchangeable black and photo-quality color pens, either of which is used in combination with a standard tri-color pen. This capping system used a multiple sealing lip system to seal across (perpendicular to) the encapsulant beads.

One other earlier capping system, is currently commercially available in the DeskJet® 850C, 855C, 820C and 870C model color inkjet printers, sold by the Hewlett-Packard Company of Palo Alto, Calif. The capping system in these earlier printers used a multiple sealing lip system to seal along the length of the encapsulant beads. That is, in this earlier design the multiple sealing lips ran parallel to the encapsulant beads to-accommodate for manufacturing tolerance accumulation and/or cap placement tolerance, so at least one of the multiple lips would land in a suitable location on the orifice plate to form a seal. Unfortunately, these fine multiple lips are very difficult to manufacture, Often the lips break off as they are removed from the mold, so the scrap rate is relatively high, which translates to a higher overall piece price for the printer manufacture. Indeed, only a few companies are even capable of consistently producing quality caps of this multi-lip design.

Proper capping requires providing an adequate hermetic seal without applying excessive force which may damage the delicate printheads or unseat the pens from their locating datums in the carriage. Moreover, it would be desirable to provide such a capping system which is more economical to manufacture than earlier capping systems, and which can be manufactured by a variety of vendors.

SUMMARY OF THE INVENTION

According to one aspect of the present invention, a capping system is provided for sealing ink-ejecting nozzles of an inkjet printhead in an inkjet printing mechanism. The capping system includes a support frame moveable between a rest position and a sealing position, with the frame including a cap base portion. The system also has a printhead cap supported by the cap base portion. The cap has a sealing lip sized to surround and seal the printhead nozzles when the frame is in the sealing position. The cap lip has a sealing region that is substantially planar before sealing the printhead. The sealing region has a central portion bordered by two opposing bands. The central portion of the sealing region has a hollow cavity thereunder into which the central portion deflects when sealing the printhead so the two opposing bands substantially form a seal against the printhead in the sealing region of the lip.

According to another aspect of the present invention a capping system is provided for sealing ink-ejecting nozzles of an inkjet printhead in an inkjet printing mechanism. The capping system includes a support frame that is moveable between a rest position and a sealing position, with the frame including a cap base portion. The capping system also has a printhead cap supported by the cap base portion. The cap has a sealing lip sized to surround and seal the printhead nozzles when the frame is in the sealing position so the sealing lip and the printhead define a sealing chamber between them when the frame is in the sealing position. The base portion defines a vent hole through which the sealing chamber is coupled to atmosphere. The cap includes a bottom wall joining the sealing lip and extending across the base portion. The cap also has a neck region that surrounds the vent hole and projects into the sealing chamber above the bottom wall of the cap.

According to another aspect of the present invention, an inkjet printing mechanism may be provided with a capping system as described above.

According to a further aspect of the present invention, an inkjet printing mechanism may be provided as including one of the capping systems described above.

An overall goal of the present invention is to provide an inkjet printing mechanism which prints sharp vivid images over the life of the pen and the printing mechanism, particularly when using fast drying pigment or dye-based inks.

A further goal of the present invention is to provide a capping system that adequately seals inkjet printheads in an inkjet printing mechanism, with the capping system being easier to manufacture than earlier systems to provide consumers with a reliable and economical inkjet printing unit.

BRIEF DESCRIPTION OF THE DRAWINGS

FIGS. 8–10 are enlarged, side elevational, sectional views of the sealing lip portion of the high deflection capping system of the present invention, with:

FIG. 8 shown before sealing a printhead,

FIG. 9 shown sealing a flat portion of a printhead, and

FIG. 10 shown sealing over an encapsulant bead of a printhead.

DETAILED DESCRIPTION OF A PREFERRED EMBODIMENT

Figure 1:
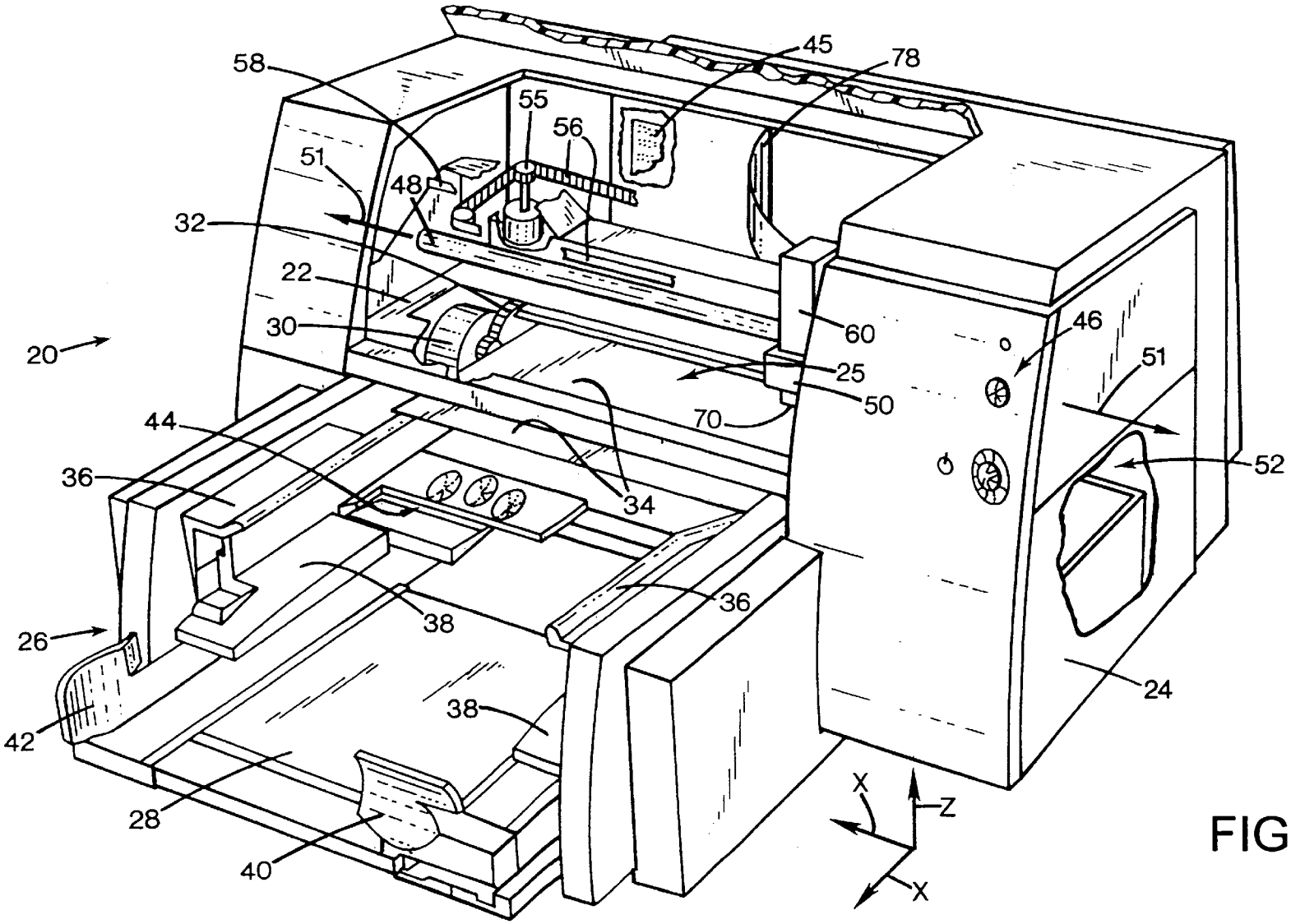
FIG. 1 is a perspective view of one form of an inkjet printing mechanism, here, an inkjet printer, including a printhead service station having one form of a high deflection capping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, mylar, and the like, but for convenience, the illustrated embodiment is described using paper as the print medium. The media handling system 26 has a feed tray 28 for storing sheets of paper before printing. A series of conventional paper drive rollers (not shown), driven by a stepper motor and drive gear assembly 30, 32 may be used to move the print media from tray 28 into the printzone 25, as shown for sheet 34, for printing. After printing, the motor 30 drives the printed sheet 34 onto a pair of retractable output drying wing members 36, shown in an extended position. The wings 36 momentarily hold the newly printed sheet above any previously printed sheets still drying in an output tray portion 38, then the wings 36 retract to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and an envelope feed port 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a quad inkjet pen carriage system 50 for travel back and forth across the printzone 25 along a scanning axis 51. The carriage 50 is also propelled along guide rod 48 into a servicing region, as indicated generally by arrow 52, located within the interior of the housing 24. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage 50 along guide rod 48 in response to rotation of motor 55.

To provide carriage positional feedback information to printer controller 45, an encoder strip 58 extends along the length of the printzone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

Figure 2:
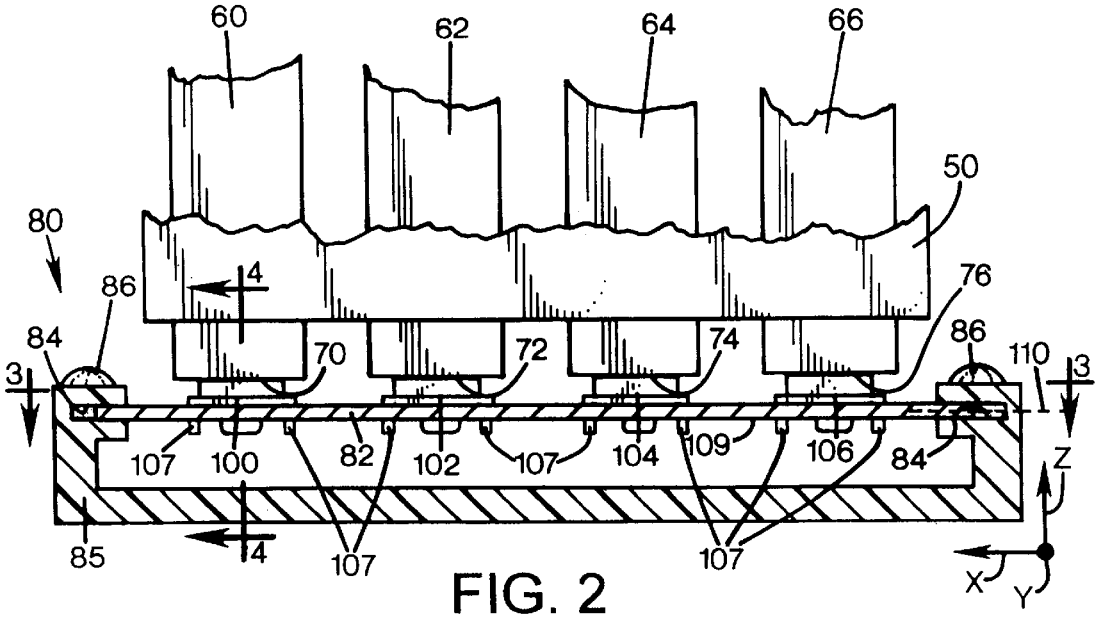
FIG. 2 is an enlarged front elevational sectional view of the capping assembly of FIG. 1, shown supported by a sled and sealing four discrete inkjet printheads mounted in a single carriage.

In the printzone 25, the media sheet 34 receives ink from an inkjet cartridge, such as a black ink cartridge 60 and three monochrome color ink cartridges 62, 64 and 66, shown schematically in FIG. 2. The cartridges 60–66 are also often called "pens" by those in the art. The black ink pen 60 is illustrated herein as containing a pigment-based ink. While the illustrated color pens 62–66 may contain pigment-based inks, for the purposes of illustration, pens 62–66 are described as each containing a dye-based ink of the colors cyan, yellow and magenta. It is apparent that other types of inks may also be used in pens 60–66, such as paraffin-based inks, as well as hybrid or composite inks having both dye and pigment characteristics.

The illustrated pens 60–66 each include reservoirs for storing a supply of ink therein. As mentioned in the Background section above, the reservoirs for each pen 60–66 may contain the entire ink supply for the printer for each color, which is typical of a replaceable cartridge, or they may store only a small supply of ink in what is known as an "off-axis" ink delivery system. The replaceable cartridge systems carry the entire ink supply as the printhead reciprocates over the printzone 25 along the scanning axis 51. Hence, the replaceable cartridge system may be considered as an "on-axis" system, whereas systems which store the main ink supply at a stationary location remote from the printzone scanning axis are called "off-axis" systems. In an off-axis system, ink of each color for each printhead is delivered via a conduit or tubing system from the main stationary reservoirs to the on-board reservoirs adjacent to the printheads. The pens 60, 62, 64 and 66 have printheads 70, 72, 74 and 76, respectively, which selectively eject ink to form an image on a sheet of media in the printzone 25. The concepts disclosed herein for sealing the printheads 70–76 apply equally to the totally replaceable inkjet cartridges and to the off-axis semi-permanent or permanent printheads.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 51, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 45 to the printhead carriage 50.

High Deflection Capping System

Figure 3:
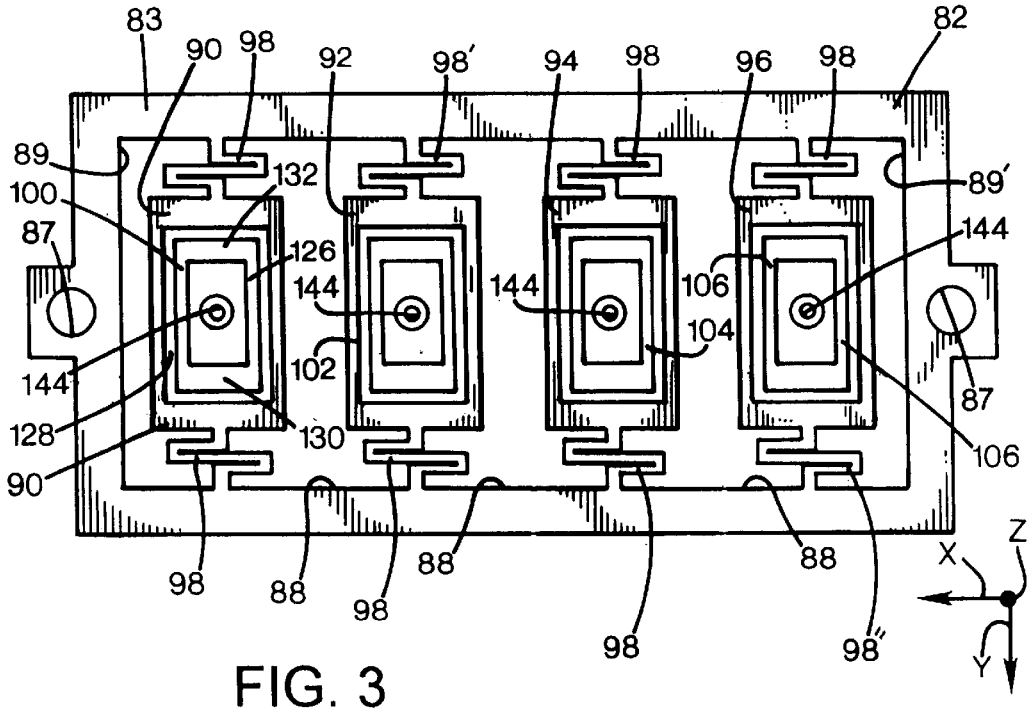
FIG. 3 is a top plan view taken along line 3—3 of FIG. 2, with the sled omitted for clarity.

FIGS. 2 and 3 illustrate one form of a high deflection capping system 80 constructed in accordance with the present invention for sealing the printheads 70–76 of pens 60–66. In the illustrated embodiment, the capping system 80 includes a flexible frame 82 that has an outer border portion 83 which is received within a pair of slots 84 of a capping sled portion 85. To secure the frame 82 to the sled 85, two fasteners, such as rivets or self-tapping screws 86, are inserted into a pair of holes (not shown) in sled 85, with the fasteners also engaging a pair of holes 87 defined by the frame border 83. While a screw and slot arrangement is shown to attach the frame 82 to sled 85, it is apparent that a variety of other attachment means may be used to secure the frame 82 to the sled. For example, rather than sliding the frame 82 into slots 84, each slot 84 may be closed at each end, and the frame 82 flexed for insertion into the slots 84.

The flexible frame 82 may be constructed of any type of plastic or metallic material having a spring characteristic that allows the frame to return to its natural, preferably flat, state after being stressed or bent into a position away from that natural state. The preferred material for the frame 82 is a stainless steel, such as ASTM 301 or 304 stainless steel, preferably full-hard and cold-rolled which provides a substantially constant spring-rate over the life of the frame 82, or a precipitation hardening steel alloy like type 17-7 typically used to make springs and structural components. For instance, a frame 82 constructed of a metallic shim stock material, on the order of 0.508 millimeters (nominally 0.020 inches) thick, was found to perform suitably. A stainless steel is preferred because it has superior durability and resistance to corrosion, not only from the ink but also from other environmental factors, such as high humidity or rapid changes in temperature during transport. In addition to the 300-series stainless steel alloys, it is also believed that other alloys would be suitable, for example the 400-series of stainless alloys.

Conventional spring steels may also be suitable for frame 82, although they may need some surface preparation, such as a paint or other coating to protect them from corrosion due to environmental factors or from degradation caused by the ink itself. While various plastic materials were not tested, it is believed that plastics may also serve as suitable materials for the flexible frame 82. However, given the performance characteristics of the current commercially available plastics, metals are preferred because these plastics have a tendency to creep when stressed. "Creep" is a term used in the plastics industry to describe the failure of a plastic to return to its original shape after being stressed without losing any restoring force or spring rate. The metals proposed herein for frame 82 do not suffer creep failure. Moreover, preferably onsert molding techniques are used to manufacture capping assembly 80, and the use of a metal frame 82 allows for higher onsert molding temperatures. Such higher onsert molding temperatures are believed to promote better bonding of elastomers to the frame 82, as well as more complete curing or cross-linking of the elastomeric material. Higher molding temperatures also yield faster curing times, which in turn provides a shorter manufacturing cycle, with a resulting lower cost to manufacture the cap assembly 80. Indeed, if the cap sled 85 is of a plastic material, the frame 82 may be insert molded as an integral portion of the sled 85.

As described in the Background section above, the cap sled 85 may be moved into engagement with the printheads 72–76 in a variety of different manners known to those skilled in the art. For instance, the cap sled 85 may approach the printheads 70–76 translationally, rotationally, diagonally or though any combination of these motions, depending upon the type of sled movement mechanism employed. Several different movement mechanisms and sled arrangements are shown in U.S. Pat. Nos. 4,853,717; 5,103,244; 5,115,250; 5,155,497; 5,394,178; 5,440,331; and 5,455,609, all assigned to the present assignee, the Hewlett-Packard Company. Indeed, in other pen support mechanisms, it may be more practical to move the printheads 70–76 into contact with the capping system 80, or to move both the printheads and the capping system 80 together into a printhead sealing position.

As best shown in FIG. 3, inside the border 83 a series of intricately fashioned holes or recesses 88, 89 and 89' have been cut through frame 82 to define four cap bases 90, 92, 94 and 96 which lie under the respective printheads 70, 72, 74 and 76 during capping. At each end of the cap bases 90–96, the base is attached to the border 83 by a suspension spring element, such as an S-shaped spring member 98 defined by the holes 80, 89 and 89' formed through the frame 82. The holes 80, 89 and 89' may be formed by removing material from the frame 82, for example through laser removal techniques, etching, punching or stamping, or other methods known to those skilled in the art. The spring elements 98 may take a variety of different forms, and the configurations for springs 98 shown herein are by way of illustration only to describe-the-concepts of the flexible frame support system. Thus, it is apparent that other spring configurations may also be used to implement these concepts, such as those shown in the parent application identified under the Related Applications section above, and which is hereby incorporated by reference.

Preferably four elastomeric sealing lips 100, 102, 104 and 106 are onsert molded onto each of the cap bases 90, 92, 94 and 96, respectively. The manner of onsert molding the cap lips 100–106 onto the bases 90–96 may be done in a variety of different manners known to those skilled in the art for bonding elastomeric materials to metals or plastics. For example, the flexible frame, here frame 82, may define a series of holes through the frame under the sealing lips 100–106 to allow the elastomer to flow through these holes, forming an anchoring pad or stitch point 107 of the elastomer along an underside 109 of the frame 82, with these stitch points 107 being shown in FIG. 2.

The material selected for the cap lips 100–106 may be any type of resilient, non-abrasive, elastomeric material, such as nitrile rubber, elastomeric silicone, ethylene polypropylene diene monomer (EPDM), or other comparable materials known in the art, but EPDM is preferred for its economical cost and durable sealing characteristics which endure through a printer's lifetime. Indeed, one preferred compound for the caps 100–106 is disclosed in U.S. patent application Ser. No. 08/710,597, filed on Sep. 19, 1996, which is hereby incorporated by reference, and which is assigned to the present assignee, the Hewlett-Packard Company. This preferred compound comprises a flexible elastomeric matrix containing particles of a material harder than the matrix which allow the particles to resist wear and prolong the useful life of the wiper. These particles may be of a nonabrasive, hard polymer, such as polyethylene. Preferably, the particles are bonded to the elastomeric matrix with a coupling agent, such as silane. A preferred softness for the caps 100–106 is in the durometer range of 25–45, with a more preferred value being a durometer of 35±5, as measured on the Shore A durometer scale.

This preferred elastomer is primarily formed of two different materials, an elastomeric matrix and a multitude of filler or reinforcing particles distributed throughout the matrix. In the preferred embodiment, the matrix is EPDM. When the EPDM matrix wears away and exposes poorly adhered particles, they tend to be extracted from the matrix before they have served their purpose to resist wear. Therefore, it is necessary to create a chemical attraction or bond between the particles and the matrix. Preferably, the particles are each surrounded with a coupling agent layer which may be contained within the matrix material, or may be precoated onto the particles prior to mixing with the elastomer. In the preferred embodiment, the coupling agent may be either g-aminopropyltriethoxysilane, available from OSI Specialities, Inc. of Tarrytown, N.Y., or vinyltriethoxysilane available from OSI and Dow Coming Corp. of Midland, Mich. Suitable chemical coupling agent alternatives include the chemical families of zirconates, titanates, and organic azo and azide compounds. The coupling agent serves to create a composite instead of a blend of materials, by reacting chemically with each of the composite components. The coupling agent must include a first functionality capability of reacting onto the matrix resin. This is provided either by the amino (NH2) functionality of the g-aminopropyltriethoxysilane coupling agent, or by the vinyl (CH2═CH—) functionality of the vinyltriethoxysilane coupling agent. These chemical moieties are capable of attaching themselves to the elastomeric polumer backbone, either by chemical reactions or by chemical attractions. A second functionality of the silane coupling agent is the silicotriester, Si(OR)3, where the R represents a carbon-containing alkyl group such as methyl (CH3) or ethyl (CH3CH2). Because the preferred polyethylene particles are chemically similar to the EPDM elastomer, the vinyl functional functionality can react either with the PE or with the EPDM, and the silicotriol may also be chemically attracted to both PE and EPDM. The silicoester has preferably been hydrolyzed to a Si—OH bond that is capable of chemically attaching itself to the particles either through chemical reaction, or by other bonding mechanisms such as hydrogen bonding. Preferably, this result is achieved by chemical attraction with the g-aminopropyltriethoxysilane coupling agent and chemical reaction with the vinyltriethoxysilane coupling agent. To achieve sufficient reinforcement, the particles may comprise at least 2% of the composite by weight, and should comprise no more than about 50% to avoid compromising flexibility unacceptably. Preferably, the particles comprise 20% of the composite. The coupling agent comprises about 1.0% of the particles by weight, and may range between 0.5 and 1.5%. If the coupling agent is mixed into the matrix material prior to particle mixing a ratio of 1 part silane to 500 parts matrix material is preferred. The selected coupling agent may be used to retain alternative or additional filler materials such as carbon black or silica. apparent to those skilled in the art that suitable alternative methods may be employed to produce a cap that is resistant to chemical attack and mechanical wear. First, a supply of silane is hydrolyzed by mixing with water, or, in the case of vinyl based compounds, with glacial acetic acid. Then, the hydrolyzed silane is mixed with the filler particles in the proportions discussed above to react with the particle material. The particles are then dried at 90° C. while tumbling a batch under a vacuum to leave a coating of dried hydrolyzed silane. For particles other than polyethylene, such as Teflon and carbon black, higher temperatures of about 120° C. may be used. The coated particles are then mixed with liquid matrix material to evenly disperse them throughout the mix, and to permit the matrix to react with the coating prior to or during its curing to a sold form. The mixture may be molded, extruded, or formed by any conventional means into the desired blade shape. In an alternative process, the coupling agent may be mixed into the liquid matrix material prior to adding the filler particles.

Now that the basic components of the capping system 80 have been described, the basic manner of operation and method of sealing printheads 70–76 will be discussed. To aid in explaining this operation, a Cartesian coordinate axis system, having positive XYZ coordinate axes oriented as shown in FIG. 1, will be used. Here, the positive X-axis extends to the left from the service station area 52 across the printzone 25, parallel with the scanning axis 51. The positive Y-axis is pointing outwardly from the front of the printer 20, in the direction which page 34 moves onto the output wings 36 upon completion of printing. The positive Z-axis extends upwardly from the surface upon which the printer 20 rests. This coordinate axis system is also shown in several of the other views to aid in this discussion.

While a variety of different embodiments of the spring elements are shown herein, such as springs 98, preferably each type of suspension spring accomplishes the function of having both cantilever characteristics and torsional characteristics. These cantilever and torsional characteristics of the suspension springs allow the cap bases 90–96 to flex and rotate at least a fraction of the base out of a reference plane 110, which is defined by an unflexed state of the frame border 83. This flexibility of the cap base 90 to pivot and tilt with respect to the reference plane 110 allows the bases to function as independent spring-suspended platforms, similar to the ability of a trampoline to flex with respect to its frame. The trampoline analogy breaks down somewhat because a trampoline platform stretches, whereas the illustrated bases 90–96 are substantially rigid to provide firm support for the cap lips 100–106. It is apparent that the bases 90–96 may be locally reinforced for increased stiffness without impacting the springs 98. For instance, the bases 90–96 may be stiffened by adding ribs or dimples through molding for a plastic frame, or through a stamping process for a metallic frame, or by onsert molding other stiffening materials to the base, such as a rigid plastic member.

As described further below, the upper surface of each of the caps 100–106 form sealing lips which provide a substantially hermetic seal when engaged against the respective printheads 70–76 to define a sealing chamber or cavity between each orifice plate, lip and cap base, which retards drying of the ink within the nozzles. The cap lips 100–106 may be sized to surround the printhead nozzles and form a seal against the orifice plate, although in some embodiments it may be preferable to seal a larger portion of the printhead, which may be easily done by varying the size of the sealing lips to cover a larger area of the printheads 70–76. The configuration of the preferred sealing edge of cap lips which actually contact the printheads 70–76 is described further below with respect to FIGS. 4–10.

Figure 4:
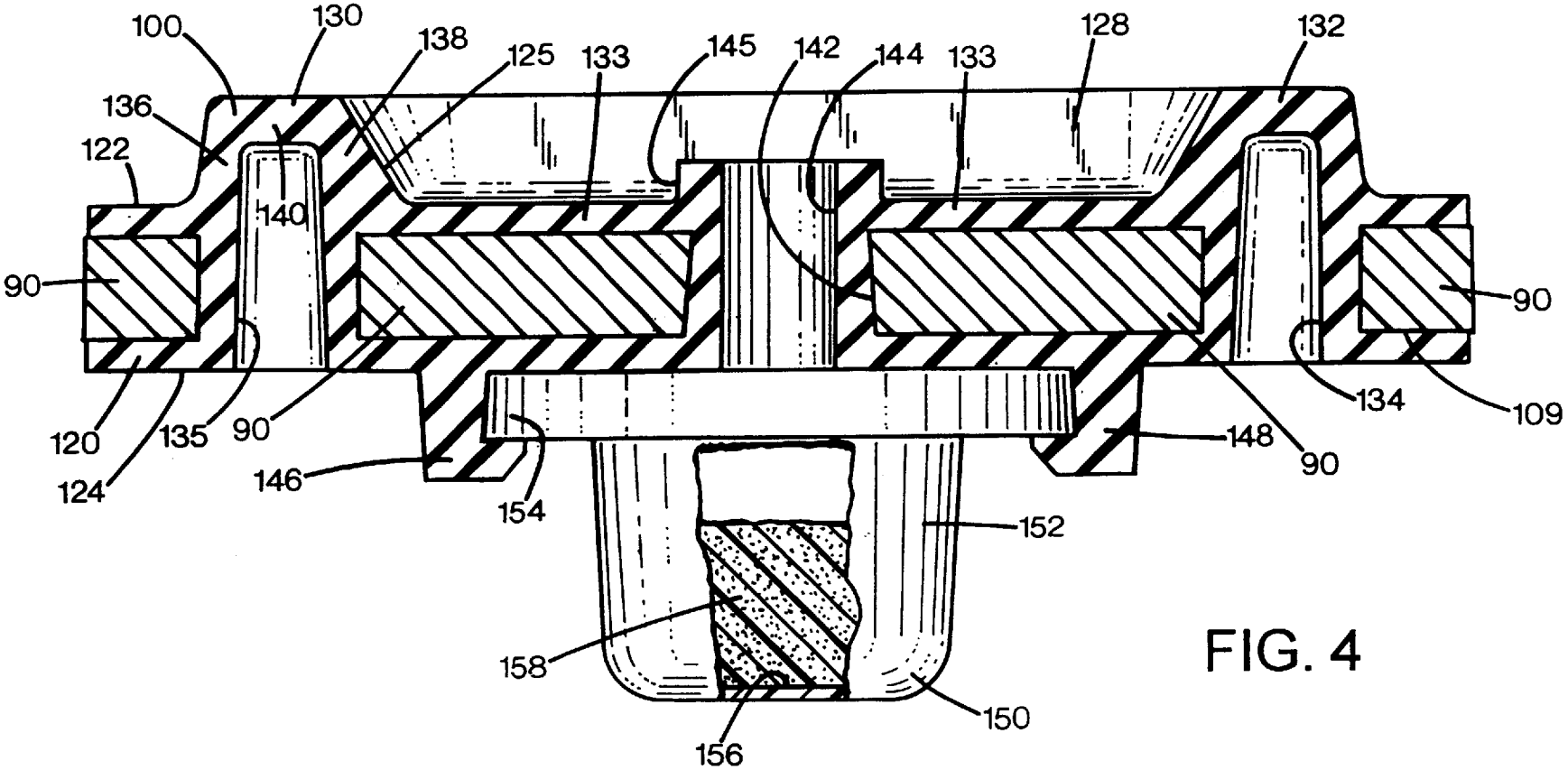
FIG. 4 is an enlarged, side elevational, sectional view taken along line 4—4 of FIG. 2.

FIG. 4 shows a cross section of cap 100 as including an elastomeric body 120 onsert molded around the cap base 90. The body has an upper surface 122 projecting upwardly to seal the printhead 60, and a lower surface 124 extending downwardly from the lower surface 109 of the cap base 60. The upper surface 122 is contoured to form a generally rectangular shaped sealing chamber 125, defined by an opposing pair of longitudinal lips 126, 128, and an opposing pair of high deflection lateral sealing lips 130, 132, as also shown in FIG. 3. The cap body 120 also has a bottom wall 133 which extends between lips 126–132 along the upper surface of the cap base 90 to line the sealing chamber 125 with elastomer, which advantageously avoid leaks encountered in the earlier printers at the lip/sled interface. Projecting inwardly from the body lower surface 124 directly under lips 132, 130 are two deflection cavities 134, 135, respectively. While it is apparent that the shapes of the lips 130 and 132 may be varied, in the illustrated embodiment, these high deflection lips 130, 132 are symmetrical, so a discussion of the operation of lip 130 will suffice to explain the operation of lip 132. Here, the deflection cavity 135 serves to define opposing exterior and interior walls 136, 138 of lip 130, with the walls 136, 138 being bridged by a sealing wall 140. The outer surface of the interior wall 138 assists in defining the sealing chamber 125. Before discussing the operation of the high deflection sealing lips 130, 132 with respect to FIGS. 8–10, the remainder of the components of cap 100 will be described.

As mentioned in the Background section above, there are a variety of different methods for venting the sealing chamber when contacting the printheads 70–76 with lips 100–106 to relieve pressure and prevent pushing air into the orifices, which otherwise could deprime the pens. In the illustrated embodiment, each of the cap bases 90–96 has a vent aperture, such as hole 142, extending from the sealing chamber to a lower surface 109 of the frame 82. During the onsert molding process, a vent throat 144 of elastomer lines the hole 142 and extends from the body upper surface 122 through to the lower surface 124. Adequate venting may be provided by adjusting the size of the effective diameter of the vent throat 144.

Preferably, the vent throat 144 extends upwardly above the bottom wall 133 of the sealing cavity 125 to define an entry neck portion 145. The neck 145 advantageously prevents minor ink leakage from the printhead 70, such as during an accidental drool event, from immediately draining into the vent throat 144. Moisture can also accumulate in the cap chamber 125 as moisture trapped in the air inside the sealing chamber begins to condense. The exterior upper periphery of the neck 145 is preferably formed with a relatively sharp corner (when viewed in cross section in FIG. 4) approximating 90° (neglecting draft deviations required for the molding process). This sharp periphery of neck 145, in combination with the meniscus forces operating along the upper surface of an ink pool, serves to hold back a substantial amount of ink from falling into the vent throat 144.

The lower surface 124 of the cap body 120 preferably is formed with at least two basin gripping ridges 146, 148 which resiliently grip a catch basin 150. The catch basin 150 has a bowl portion 152 and a rim portion 154 extending outwardly from the upper edge of the bowl 152. Opposing sides of the rim 154 are grasped by the gripping ridges 146, 148 to hold the basin tightly against the lower surface 124 of the cap body 120, with the bowl 152 positioned to collect any ink escaping from the sealing cavity 125 through the vent throat 144.

While an interior portion 156 of the bowl 152 may be left empty, in the illustrated embodiment, the bowl 152 is filled with an absorbent pad 158 which may be of any type of liquid absorbent material, such as of a felt, pressboard, sponge or other material, here shown as a sponge pad 158. The sponge pad 158 may be shipped from the factory in a dry state, but more preferably, the sponge 158 is soaked with a hygroscopic material, such as PEG (polyethylene glycols), LEG (lipponic-ethylene glycols), DEG (diethylene glycols) or glycerine. These hygroscopic materials are liquid or gelatinous compounds that can absorb up to their own weight in water. After sealing the printhead 70, any previously absorbed water is released from the hygroscopic material reducing the rate of evaporation required from the nozzles to humidify the sealing chamber 125 up to near a 100% relative humidity state that assists in preventing the ink inside the printhead nozzles from drying. Eventually this saturated condition within the sealed cap tapers off to ambient relative humidity, through a vent passageway, described further below with respect to FIGS. 12–13 and 15. In addition, the use of a hygroscopic material in conjunction with pad 158 displaces and reduces the volume of air that must reach the saturation point within the sealed cap. The reduced cap volume more quickly reaches equilibrium with the diffusion rate of the vent path, leaving the nozzles in a preferred start-up state, particularly after a short period of time in a capped state. Moreover, when using pad 158, the foam aids in handling ink leakages, such as from accidental pen drool events.

Figure 5:
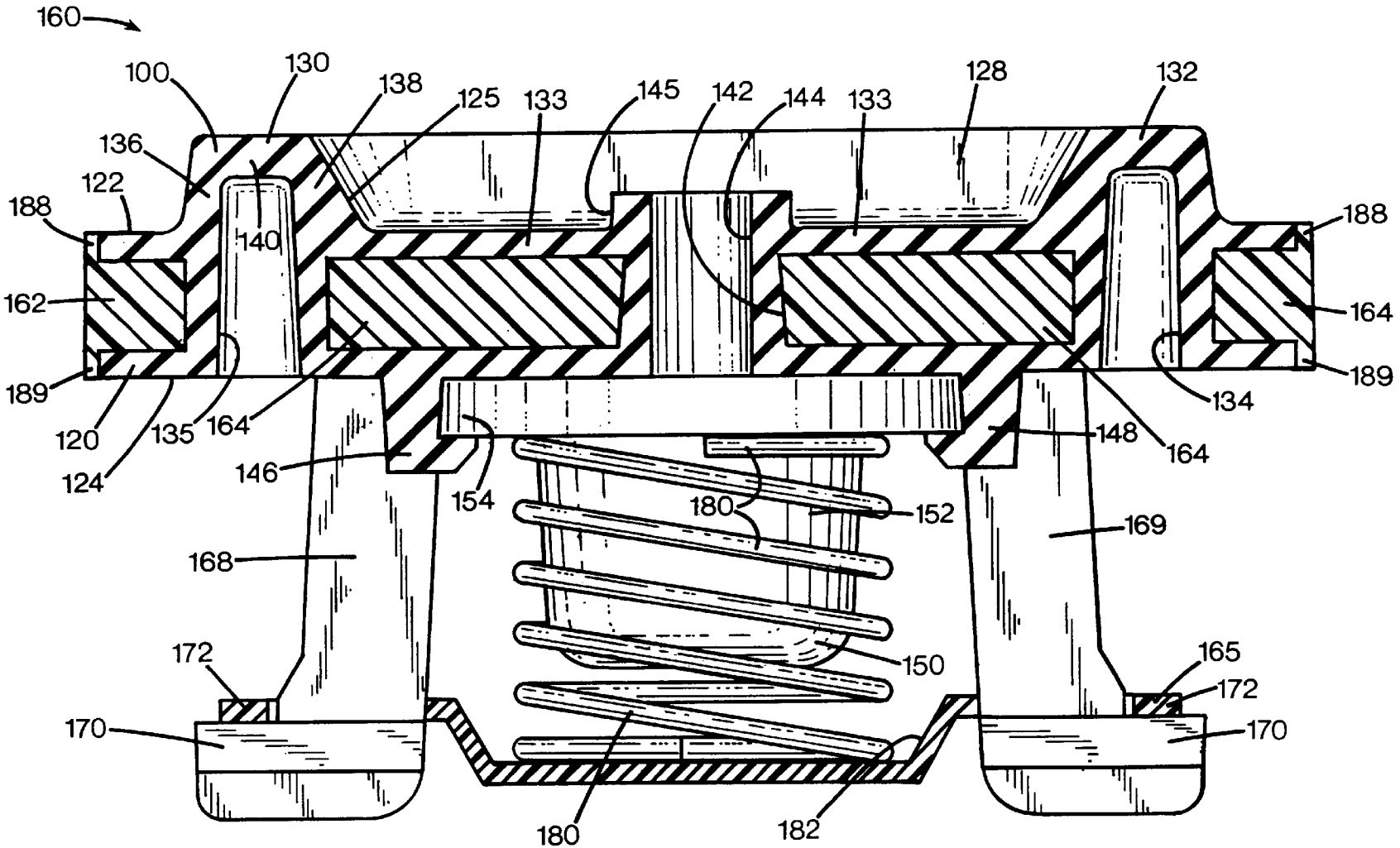
FIG. 5 is an enlarged, side elevational, sectional view of an alternate manner of supporting the high deflection capping system of the present invention.
Figure 6:
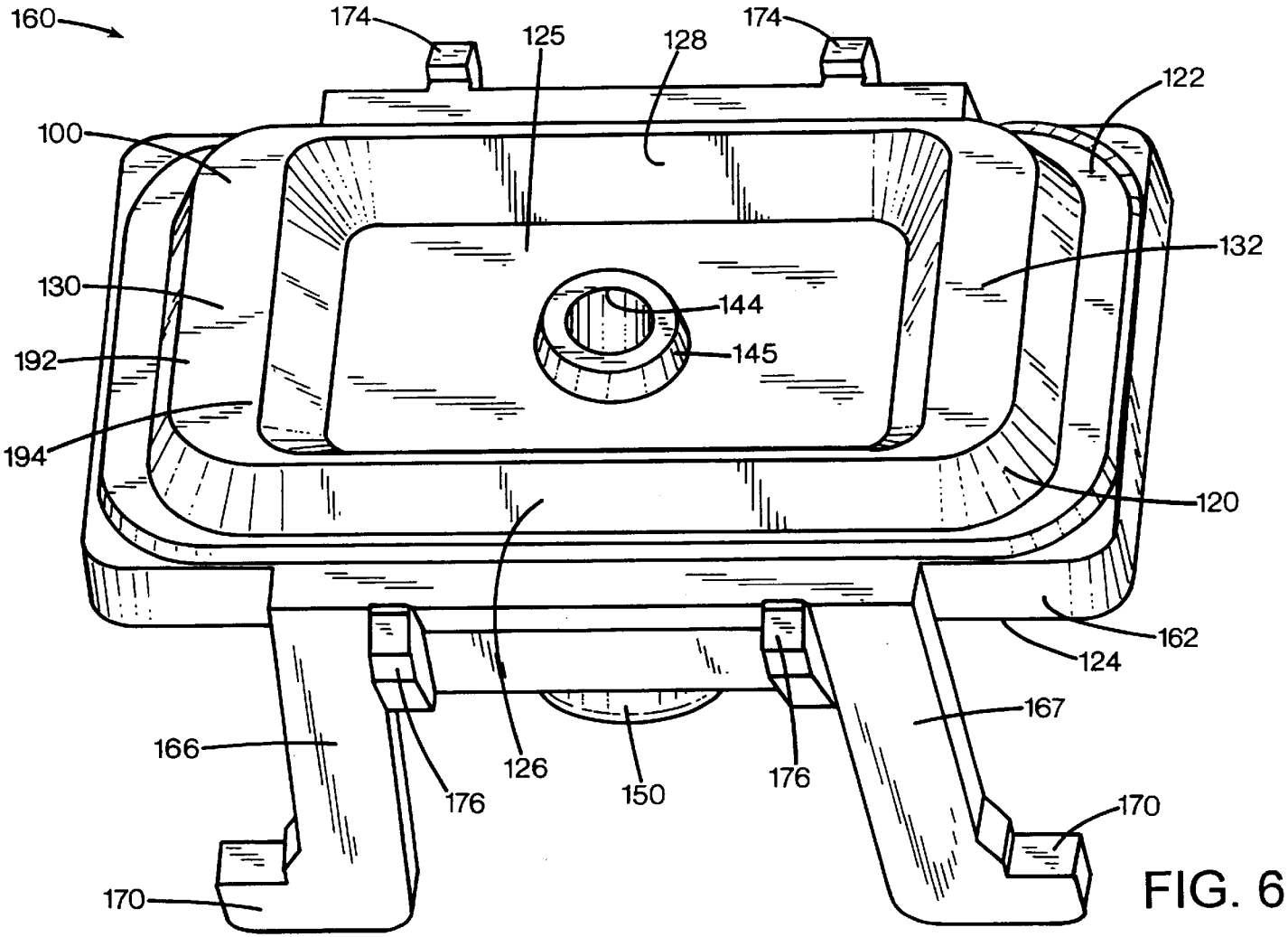
FIG. 6 is an enlarged perspective view of the capping system of FIG. 5.
Figure 7:
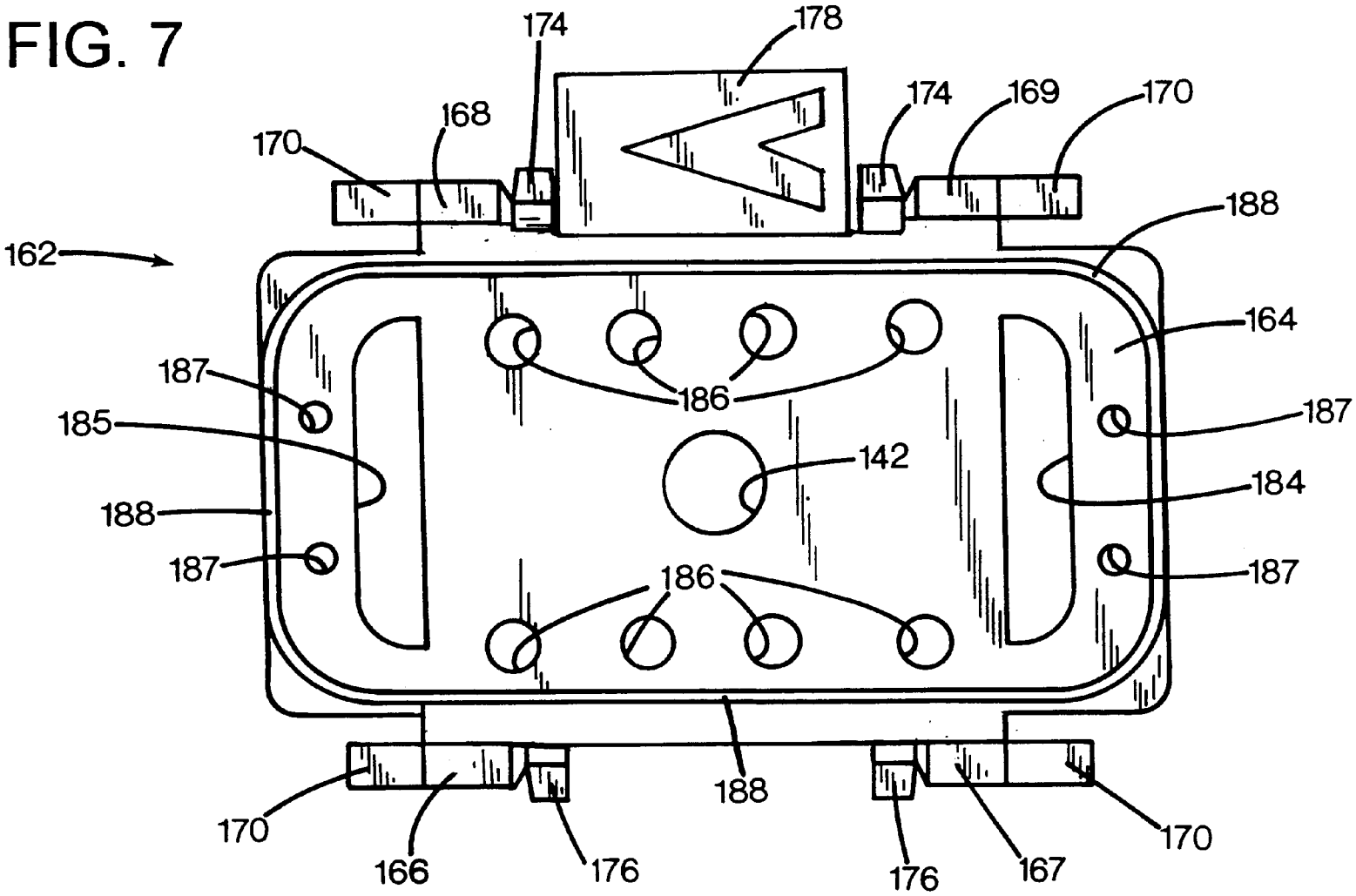
FIG. 7 is a top plan view of the support member upon which the high deflection cap of FIG. 5 is onsert molded.

FIG. 5 shows an alternate high deflection capping system 160 constructed in accordance with the present invention using the elastomeric cap body 100 shown in FIG. 24, in combination with an alternate support frame 162, here molded of a plastic material suitable for withstanding onsert molding temperatures and pressures. The frame 162 includes a base portion 164 which joins the cap assembly to a service station sled 165. To couple the cap assembly 100 to the sled 165, the frame 162 has four legs 166, 167, 168 and 169 projecting downwardly from the base 164, with each leg 166–169 terminating in a foot portion 170, as also shown in FIG. 6. Each of the feet 170 is captured by a location arm 172 portion of the sled 165, with the arms 172 in the illustrated embodiment extending outwardly from a position underneath the frame base 164. As shown in FIGS. 6 and 7, a first and second pairs of location datums 174, 176 may extend from the frame base 164 to engage a pen alignment member 178, shown schematically in FIG. 7, or to engage datums 176 and 174 on an adjacent base that supports another cap.

As shown in FIG. 5, a biasing member, such as a compression coil spring 180, is used to urge the cap assembly away from the service station sled 165 and into engagement with the printhead. The sled 165 defines a recessed pocket 182, located centrally under the cap assembly 100, that receives the lower portion of spring 180. The upper end of spring 180 wraps around the catch basin bowl 152, and pushes against the lower surface of the basin rim 154. The feet 170 of each of the frame legs 166–169 are pulled upwardly under the force of spring 180 into engagement with the lower surface of the sled location arms 172 when uncapped. When capped, the capping force slightly compresses the spring 180, allowing the legs 166–169 to move downwardly away from the service station sled 165.

Before leaving the description of the cap frame 162, several other feature that assist in facilitating the onsert molding process should be noted. FIG. 7 shows the illustrated embodiment of the cap frame 162 before the onsert molding process has occurred to form the cap body 120. To form the deflection cavities 134, 135, the base 164 two slots 184, 185 extending therethrough. To help secure the upper and lower portions of the cap body 120 to the base 164, a first group of onsert mold plug holes 186 extend through the base 164 between the deflection cavity slots 184, 185. Between the slots 184, 185 and adjacent outboard edges of the base 164, a second group of onsert mold plug holes 187 extend through the base 164. The elastomeric material of body 120 flows through holes 186 and 187 during the onsert molding process. Finally to contain the elastomeric material of body 120 at the periphery of the base 164, upper and lower barriers or fences 188 and 189 project outwardly from the respective upper and lower surfaces of the base, as shown in FIGS. 5 and 7.

Figure 8:
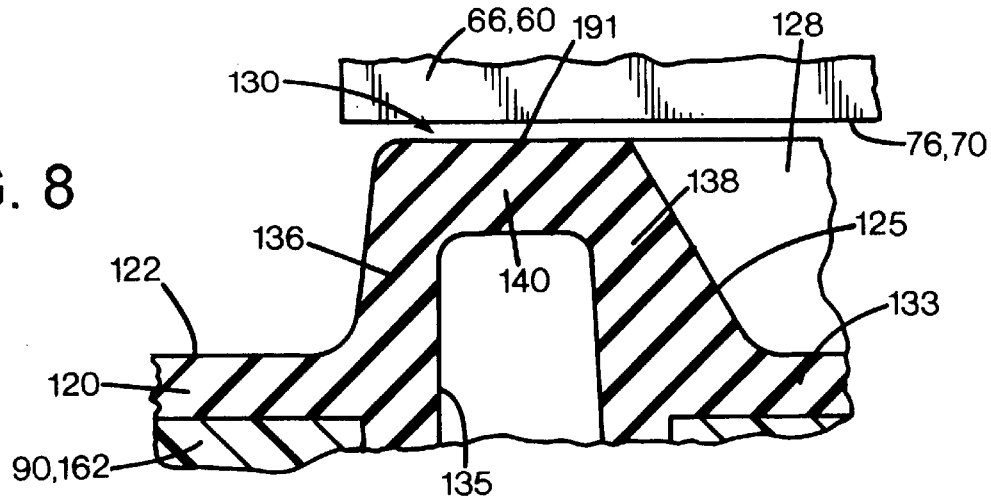
Figure 9:
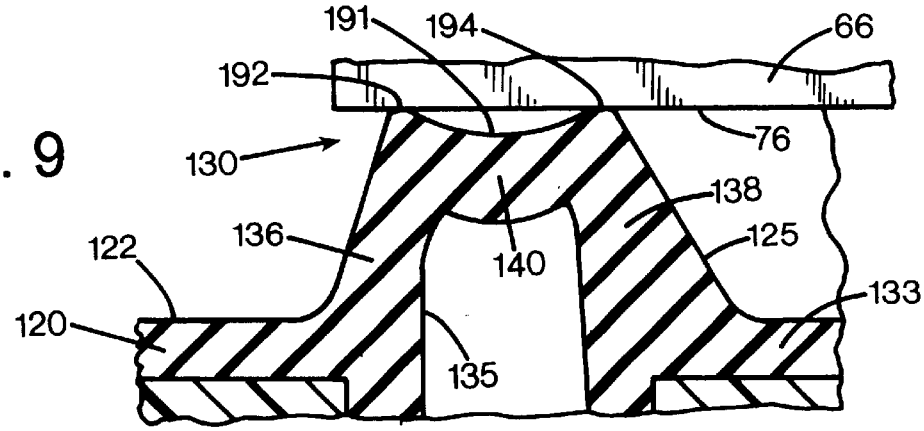
Figure 10:
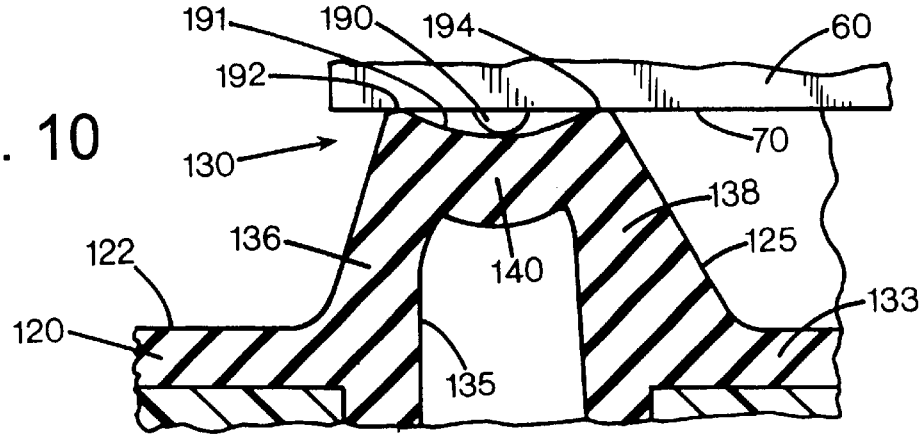

FIGS. 8–10 show the sealing of printheads 70 and 76, with FIG. 8 illustrating the configuration of the high deflection lip 130 before sealing a printhead, FIG. 9 showing the sealing a flat portion of a color printhead 76, and FIG. 10 illustrating sealing over an encapsulant bead 190 of the black ink printhead 70. To seal the printhead, the lip 130 comprises a sealing region that has a central portion 191 which deflects downwardly into the hollow deflection cavity 135 to form a smiling shape when viewed in cross section as shown in FIGS. 9 and 10. The two extreme edges of this smile-shaped deflection form a dual seal comprisng two sealing bands 192 and 194 along the exterior and interior edges of lip 130, bordering the central portion 191. In the process of forming this smiling shape, the exterior and interior walls 136, 138 may flex or bow slightly inward or outward as the wall 140 flexes down and buckles the walls 136, 138. Indeed, the upright support provided by walls 136 and 138 assists in defining the sealing bands 192, 194. The seals 192, 194 join each other at the ends near where lips 130 and 132 join the longitudinal lips 126 and 128. Thus, the two opposing bands 192, 194 substantially form a seal against the printhead in the sealing regions 130, 132 of the cap lip.

This dual seal 192, 194 may be viewed by pressing the cap 100 against a clear surface, such as a glass window pane. The dual seal feature advantageously accommodates sealing over other surface irregularities, such as ink residue, lint or other debris, which may inadvertently cling to the orifice plate 70–76. For example, an errant lint fiber trapped under the interior seal 194 would have no adverse effect on the performance of the exterior seal 192. Thus, the humid environment inside the sealing cavity 125 when capping would be maintained by seal 192, despite the presence of any leakage caused by the lint fiber under seal 194. Indeed, the encapsulant bead 190 of FIG. 10 presents no difficulty for the lip 130, which just flexes a little more than when sealing against a flat surface in FIG. 9. Preferably, the lips 130, 132 are sized and positioned to surround the encapsulant beads 190 on the printhead 70.

Figure 11:
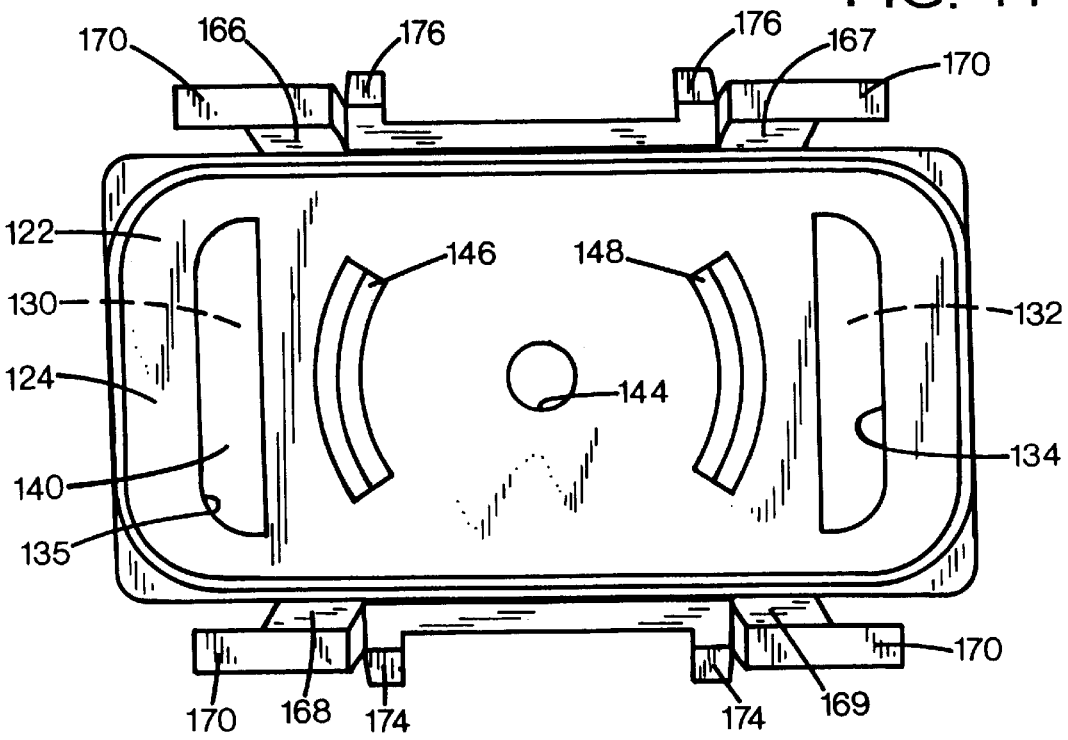
FIG. 11 is a bottom plan view of the capping system of FIG. 5, shown with the catch basin removed.
Figure 12:
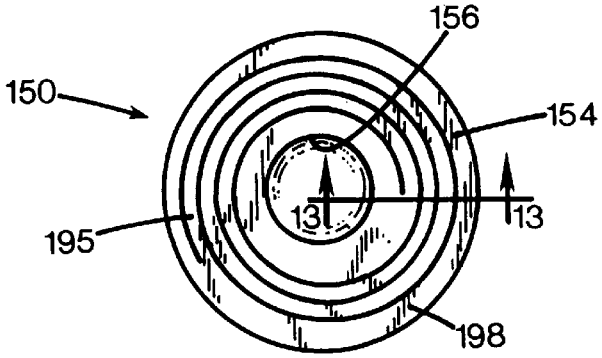
FIG. 12 is a top plan view of the catch basin portion of the capping system of FIG. 5.
Figure 13:
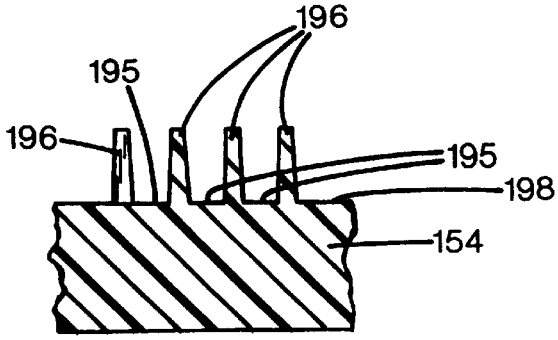
FIG. 13 is an enlarged, side elevational, sectional view taken along line 13—13 of FIG. 12.

FIG. 11 shows the bottom surface 124 of the cap body 120 with the catch basin removed to better illustrate the shape of the basin gripping ridges 146, 148. To prevent the cap 100 from forcing air into the printhead nozzles, the vent throat 144 joins the sealing cavity 125 to the basin interior 156. As shown in FIGS. 12 and 13, the upper surface of rim 154 has a trough, here shown as a spiral groove formed therein to define a vent passageway 195 when assembled against the body lower surface 124. In the illustrated embodiment, the spiral vent path 195 is defined by a spiral ridge 196 extending upwardly from an upper surface 198 of the basin rim 154. The vent passageway 195 extends from an entrance port at the chamber basin chamber 156 to an exit port at ambient atmosphere to provide the last portion of the vent path from the sealing chamber 125 to atmosphere. Preferably, the vent tunnel 195 has a long and narrow configuration, with a small cross sectional area to prevent undue evaporation when the printhead is sealed, while also providing an air vent passageway during the initial sealing process. By varying the length of the spiral vent path 195, a desired rate of venting may be easily achieved.

Figure 14:
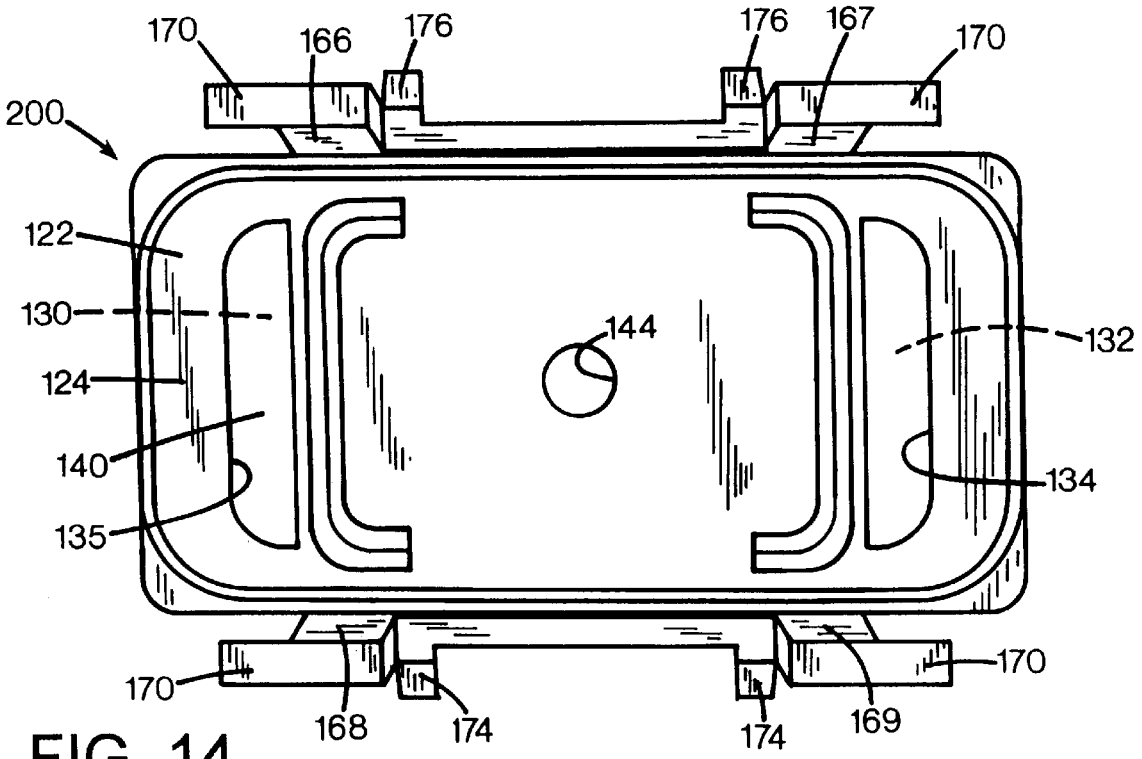
FIG. 14 is a bottom plan view of an alternate embodiment of the high deflection capping system of the present invention, with the catch basin removed.
Figure 15:
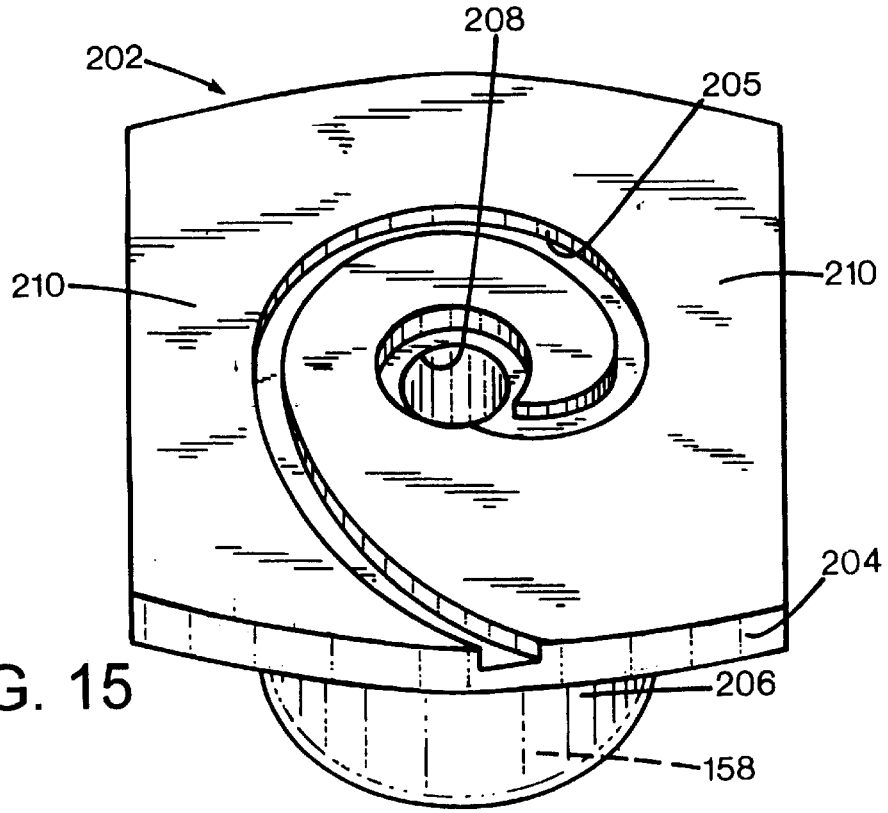
FIG. 15 is an enlarged perspective view of an alternate catch basin design for use with the capping system of FIG. 14.

FIGS. 14 and 15 illustrate an alternate high deflection capping system 200, constructed in accordance with the present invention, as including all of the components of system 160, except an alternate catch basin 202 having a larger surface rim 204 is used to define a vent passageway 205. The catch basin 202 has a catch bowl portion 206, that may be of the same construction as bowl 152, preferably filled with a hygroscopic material soaked pad 158. The entrance to the bowl 206 is provided by a mouth portion 208, located at the beginning or entrance port of the vent path 205. The upper surface of the rim 204 has a larger land area 210 adjacent the vent groove 205 than in the basin 150 of FIG. 12. The tight seal between the land 210 and the cap body lower surface 124 forms capillary passageways therebetween, which assist in drawing and pooled ink or moisture out of the vent path 205. Thus, the vent path remains free to let air pass therethrough from the sealing cavity 125 to atmosphere during capping.

Conclusion

A variety of advantages are realized using the high deflection capping systems 100, 160, such as the ability to easily mold the cap body 120. The elimination of the multiple ridge lip concept used in the earlier designs provides a cap that is easier to mold, and indeed, may be economically manufactured by a variety of vendors. This design then allows the printer manufacturer to obtain viable part price quotations from more vendors, to obtain a better cap price, a savings which may then be passed on to the consumer. The multiple ridged lips occasionally had problems with debris becoming trapped between the ridges, with a resulting decline in sealing performance, a problem which advantageously disappears when using the high deflection cap lips 130 and 132.

Besides leakage control, discussed above, a further advantage of constructing the chamber 125 with a continuos elastomeric body is the prevention of unwanted leakage between the elastomer lips and the cap support, as experienced in the earlier models discussed in the Background section above. The earlier printers had to use higher capping forces to not only seal the lips at the printhead, but also to seal the lip/sled interface where the support sled formed a portion of the sealing cavity. Indeed, the illustrated cap 100 only needs a capping force on the order of 75% of that required by these earlier printers to adequately seal the printhead. Thus, there is no need to over-design both the printhead and the cap support structure to seal the printhead using caps 100–106. Furthermore, by using onsert molding techniques, the cap is permanently referenced relative to the support frame and the pen alignment datums on the frame, within much tighter tolerances as opposed to earlier cap designs that used a separate cap lip expanded to fit over a carrier. These earlier designs unfortunately often slipped from their positions on the carrier, twisting or turning relative to the carrier frame leaving some nozzles uncapped. Use of the stitch points 107 and the associated onsert molding techniques, in addition to the deflection cavities 134, 135 produces a reliable, efficient and cost effective capping system.

Use of the catch basin 150, particularly when filled with the hygroscopic material soaked pad 158, advantageously handles ink spills and moisture accumulation while maintaining a humidified environment when the printhead is sealed. The capillary vent path provided by the rim portion of the catch basin, as shown in FIGS. 12, 13 and 15, prevents depriming the nozzles as sealing is initiated. Furthermore, use of the gripping ridges, such as 146 and 147, formed along the lower surface 124 of the cap body 120 aids in easily assembling the basin 150 to the cap body, particularly when using automated techniques to construct the embodiment of system 160.

A further advantage of the cap body 120 is the ability to adapt the design to a variety of different support structures, such as the metallic flexible frame 82 and the plastic frame 162. As discussed at length above with respect to FIGS. 8–10, the high deflection lips 130, 132 are capable of providing a superior seal, not only over a relatively flat portion of a printhead, as shown in FIG. 9, but also over significant surface irregularities, such as the encapsulant bead 190 as shown in FIG. 10. In making these seals, the central portion of the lips 130, 132 deflects downwardly into the deflection cavities 135, 134, forming a smiling shape when viewed in cross section as shown in FIGS. 9 and 10. The two extreme edges of this smile-shaped deflection form a dual seal 192, 194 along the interior and exterior edges of the lips 130, 132. Thus, the sealing capabilities of the earlier multiple ridged cap lips is achieved using the high deflection capping systems 100, 160, while avoiding the pitfalls of the earlier designs.

I claim:

1. A capping system for sealing nozzles of an inkjet printhead, comprising:

a support frame which moves between rest and sealing positions;

a cap base supported by the frame; and a cap lip supported by the cap base, with the cap lip having a sealing region which is substantially planar in the rest position, and when in the sealing position with the lip pressed against the printhead, the sealing region forms a cross-sectional smile-shaped deflection with two extreme edges forming a dual seal against the printhead.

2. A capping system according to claim 1 wherein:

the cap lip dual seal, printhead, and cap base define a sealing chamber therebetween when in the sealing position;

the base portion defines a vent hole therethrough, coupling the sealing chamber to atmosphere; and a neck member that surrounds the vent hole and projects into the sealing chamber.

3. A capping system according to claim 2 wherein:

the cap is of an elastomeric material and includes a bottom wall joining the sealing lip and extending across the base portion; and the neck member is of said elastomeric material and is unitary with the base portion.

4. A capping system according to claim 1 wherein:

the support frame comprises a flexible frame having a border portion and a spring portion that couples the cap base to the border portion; and wherein the border portion defines a reference plane, and the spring portion allows at least a fraction of the cap base to move out of the reference plane when the frame is in the sealing position.

5. A printing mechanism, comprising:

an inkjet printhead having ink-ejecting nozzles; and a capping system for sealing of the printhead nozzles, with the capping system comprising:

a sled which moves between a rest position and a sealing position;

a cap base portion supported by the sled;

a cap lip supported by the cap base; and a sealing region on the cap lip which is substantially planar just before surrounding and sealing the nozzles while moving from the rest to the sealing position, the planar sealing region forming a smile-shaped deflection when in the sealing position and viewed in cross-section, the deflection having two extreme edges forming a dual seal against the printhead.

6. A printing mechanism according to claim 5 wherein the cap has an undersurface that defines a hollow deflection cavity under the sealing region, and the sealing region has a central portion between the two extreme edges, with the central portion deflecting down into the deflection cavity when sealing the nozzles.

7. An inkjet printing mechanism according to claim 5 wherein:

the sealing lip and the printhead define a sealing chamber therebetween when the sled is in the sealing position;

the base portion defines a vent hole therethrough to couple the sealing chamber to atmosphere; and a neck member that surrounds the vent hole and projects into the sealing chamber above the bottom wall of the cap.

8. An inkjet printing mechanism according to claim 7 wherein:

the cap is of an elastomeric material and includes a bottom wall joining the sealing lip and extending across the base portion; and the neck member is of said elastomeric material and is unitary with the base portion.

9. An inkjet printing mechanism according to claim 5 wherein:

the sled comprises a flexible frame having a border portion and a spring portion that couples the cap base portion to the border portion; and wherein the frame border portion defines a reference plane, and the spring portion allows at least a fraction of the cap base portion to move out of the reference plane when the frame is in the sealing position.

10. A printing mechanism, comprising:

an inkjet printhead having ink-ejecting nozzles; and a capping system for sealing the printhead nozzles, the capping system comprising:

a sled which moves between rest and sealing positions;

a cap base portion supported by the sled; and a cap supported by the cap base, with the cap having a sealing lip configured to surround and seal the nozzles when the sled is in the sealing position, wherein the sealing lip has a sealing region defined by an interior wall and an exterior wall bridged by a planar sealing wall and defining thereunder a hollow deflection cavity, so when sealing the nozzles, the sealing wall deflects downwardly into the deflection cavity and at least one of the interior and exterior walls flexes.

11. A printing mechanism according to claim 10 wherein the cap forms a dual seal against the printhead when the sealing the nozzles, with a first portion of the dual seal comprising a junction of the interior wall and the sealing wall, and a second portion of the dual seal comprising a junction of the exterior wall and the sealing wall.

12. A printing mechanism according to claim 10 wherein the interior wall, exterior wall, and sealing wall of the cap form a cross sectional shape comprising a truncated cone which defines the hollow deflection cavity thereunder.

13. An inkjet printing mechanism according to claim 10 wherein:

the sealing lip and the printhead define a sealing chamber therebetween when the sled is in the sealing position;

the base portion defines a vent hole therethrough to couple the sealing chamber to atmosphere; and the cap includes a bottom wall joining the sealing lip and extending across the base portion, and the cap also includes a neck member that surrounds the vent hole and projects into the sealing chamber above the bottom wall of the cap to define an ink retaining pool within the sealing chamber.

14. An inkjet printing mechanism according to claim 10 wherein:

the sled comprises a flexible frame having a border portion and a spring portion that couples the cap base portion to the border portion; and wherein the frame border portion defines a reference plane, and the spring portion allows at least a fraction of the cap base portion to move out of the reference plane when the frame is in the sealing position.

* * * * *